US006364263B1

(12) United States Patent
Ryan

(10) Patent No.: US 6,364,263 B1
(45) Date of Patent: Apr. 2, 2002

(54) FIXTURE SUPPORT SYSTEM

(76) Inventor: James A. Ryan, 6 Wakefield Dr., St. Louis, MO (US) 63124

( * ) Notice: Subject to any disclaimer, the term of this patent is extended or adjusted under 35 U.S.C. 154(b) by 0 days.

(21) Appl. No.: 09/588,046

(22) Filed: Jun. 6, 2000

(51) Int. Cl.[7] ..... E06B 7/28
(52) U.S. Cl. ..... 248/250; 248/239
(58) Field of Search ..... 248/250, 235, 248/239, 247, 248; 108/108, 109

(56) References Cited

U.S. PATENT DOCUMENTS

| | | | | |
|---|---|---|---|---|
| 3,965,826 | A | 6/1976 | Markham | 108/108 X |
| 3,994,462 | A | 11/1976 | Shine | 248/248 |
| 4,151,917 | A | 5/1979 | Pugh | 248/243 |
| 4,319,531 | A | 3/1982 | Caldwell | |
| 4,373,694 | A | 2/1983 | Peterson | |
| 4,385,565 | A | 5/1983 | Roberts et al. | |
| 4,431,155 | A | 2/1984 | Engel | |
| 4,444,321 | A | 4/1984 | Carlstrom | |
| 4,460,097 | A | 7/1984 | Darnell, II et al. | |
| 4,508,301 | A | 4/1985 | Nicholson et al. | |
| 4,614,273 | A | 9/1986 | Ishii | |
| 4,691,887 | A | 9/1987 | Bessinger | |
| 4,716,841 | A | 1/1988 | Suttles | |
| 4,720,069 | A | 1/1988 | Bessinger | |
| 4,733,843 | A | 3/1988 | Bessinger | |
| 4,736,918 | A | 4/1988 | Bessinger | |
| 4,765,575 | A | 8/1988 | Bergle et al. | |
| 4,793,267 | A | 12/1988 | Birillo | |
| 4,850,285 | A | 7/1989 | Suttles | |
| 4,871,136 | A | 10/1989 | Bessinger et al. | |
| 4,915,338 | A | 4/1990 | Guth | |
| 4,934,642 | A | 6/1990 | Baron et al. | |
| 4,934,645 | A * | 6/1990 | Breslow | 248/242 |
| 5,014,952 | A | 5/1991 | Petrohilos | |
| 5,020,758 | A | 6/1991 | Rawlyk | |
| 5,064,158 | A | 11/1991 | Brazier et al. | |
| 5,138,803 | A | 8/1992 | Grossen | |
| 5,360,192 | A | 11/1994 | Pittella | |
| 5,384,198 | A | 1/1995 | Hodges | |
| 5,485,933 | A | 1/1996 | Crooymans | |
| 5,529,192 | A | 6/1996 | Conen et al. | |
| 5,575,444 | A | 11/1996 | Otema | 248/242 |
| 5,613,449 | A | 3/1997 | Pullman | |
| 5,692,717 | A | 12/1997 | Glaeser | |
| 5,695,163 | A | 12/1997 | Tayar | |
| 5,788,200 | A | 8/1998 | Jones | 248/235 |
| 5,799,803 | A | 9/1998 | Muller | 108/108 X |
| 5,803,274 | A | 9/1998 | Scheveloff | 108/108 X |

FOREIGN PATENT DOCUMENTS

| | | | |
|---|---|---|---|
| FR | 2461841 A1 | * | 2/1981 |
| GB | 2107177 A | * | 4/1983 |

* cited by examiner

*Primary Examiner*—Ramon O. Ramirez

(57) ABSTRACT

A shelving system having an appearance of a suspended shelf including a panel, a pair of narrow profile shelf clips and a cantilevered shelf secured in the shelf clips. The panel includes a vertical series of holes formed into each side. Each shelf clip has an upper and lower pin to engage holes in the side edge of the back panel. Each clip includes an upper shelf brace and a lower shelf brace defining a shelf space there between for the seating of a shelf. The upper and lower shelf braces each include a friction pad to snugly engage the upper and lower surfaces of a margin of the shelf. The friction pads are interchangeable to provide a plurality of thicknesses to adjust the dimension of the shelf space so as to accommodate shelves of varying thicknesses. In other embodiments, the shelf clips can be fashioned as display hardware including straight faceout with hooks, a round faceout, a straight shelf bracket, a hat displayer, a hangrail support bracket, a valance bracket, a hangrail support bracket or alternative configurations.

8 Claims, 3 Drawing Sheets

FIXTURE SUPPORT SYSTEM

CROSS REFERENCE TO RELATED APPLICATIONS

None

BACKGROUND OF THE INVENTION

This invention relates generally to display fixtures and, more specifically, to a shelving system including novel adjustable shelf clips and base panel.

Retailers and others with a need to store or display items have, for years, used shelves, hooks, face-outs, waterfalls, pegs and other display fixtures. A number of prior art display and/or shelving systems have been developed. For example, standards and brackets are the most common system. This system consists of a slotted "standard" which mounts to a surface, such as a wall, and a bracket that protrudes forward to support the shelf. This common system has several disadvantages. For example, the standards and brackets themselves are unattractive and obtrusive. Shelves having different depths require different size brackets and the shelves are not secured on the bracket.

Side supports are another common system and include side walls or panels on each side of the shelves. The side panels have a series of holes and pins or brackets are inserted in the holes. Again, the shelves merely rest on the pins or brackets. Furthermore, the side walls create a closed-in or cabinet like effect. A series of such racks produces a niche or nook effect when an open or spacious expanse may be preferable.

Pegboard can be used to mount brackets to seat shelves. However, shelf size is limited and pegboard is unattractive. Slatwall is a system in which a back panel is fabricated with a series of "T" shaped slots which run horizontally (and vertically in "cubewall"). A variety of shelves and fixtures are manufactured which hook into the slots. Although the exposed surfaces of slatwall is available in many more attractive options than pegboard, the slots create a grooved look which designers try to avoid. Slatwall also has size and weight limits.

The "Puck System:" is similar to pegboard but the holes are larger and the spacing between the holes is greater, i.e. 6 inch on center is common. A number of fixtures, including shelf supports, are manufactured which lock into the holes in the back panel. Unused holes are plugged with decorative pucks. Although the puck system generally can support larger shelves, the shelves are not secured to the supports. Moreover, most designers would prefer a system that did not include a plurality of holes.

To avoid the appearance of heavy mounting hardware, a designer may employ a cable system whereby shelves are suspended from the ceiling, or other top surface by small wires. This type of system is not practical for perimeter shelving because of the cost. Furthermore, these types of systems can be unstable due to swing. Fixed shelf brackets that attach directly to a wall are well known. However, these styles do not allow for adjustment for height or depth It would be desirable, therefore, to have a wall mounted shelf system that minimizes the use of unattractive and obtrusive hardware, includes a clean, aesthetically pleasing design, is adjustable, strong and supportive and can be used with variable size shelving.

SUMMARY OF THE INVENTION

It is among the objects and principles of the present invention to provide a novel shelving system which can be attached to a support surface, such as a wall, rendering an appearance that the shelf system is suspended against the wall without obtrusive mounting hardware and shelf brackets. In the preferred embodiment, the system includes a support or base panel for attachment to a wall, for example, a pair of shelf clips and a cantilevered shelf frictionally secured in the shelf clips. The panel can be any designed size and shape as long as there are two vertical opposed edges at the point where the shelf clips attach and a front and rear surface with a material thickness therebetween. The panel can be any desired dimensions, generally rectangular, and has a front surface and a rear surface with a material thickness there between. The rear surface of the panel can include a mounting frame for attachment to the wall or can employ any other appropriate mounting hardware that is not readily visible. The front surface of the panel can be of any chosen decor. Each side edge of the panel includes a vertical series of holes formed into the material thickness. The holes in the opposed side edges are parallel.

The system includes a left and a right shelf clip. Each shelf clip has an upper and lower mounting pin. The mounting pins, which extend out perpendicular to the clip itself, are disposed to engage holes in the side edge of the back panel. Each clip includes an upper shelf brace and a lower shelf brace defining a shelf space there between for the seating of a shelf. The upper and lower shelf braces each include a friction pad which snugly engage the upper and lower surfaces of a margin of the shelf respectively. The friction pads are replaceable or interchangeable and are provided in a plurality of thicknesses to effectively alter the dimension of the shelf space so as to accommodate shelves of varying thicknesses. The shelf may be a standard flat sheet-type shelf fashioned from glass, marble, veneered chip board, solid wood or other suitable material such as plastic, light weight metal or the like.

In other embodiments, the shelf clips can be fashioned as display hardware including, but not limited to, a straight faceout with hooks, a round faceout, a straight shelf bracket, a hat displayer, a hangrail support bracket, a valance bracket, a U-bar or alternative, useful configurations.

BRIEF DESCRIPTION OF THE DRAWINGS

FIG. 7 is FIG. 6A a front elevational view of a shelf clip of the shelving system of the present invention mounted to a back panel and supporting an end segment of a shelf.

Corresponding reference numerals indicate corresponding elements throughout the various drawings.

DESCRIPTION OF THE PREFERRED EMBODIMENT

Figure 1:
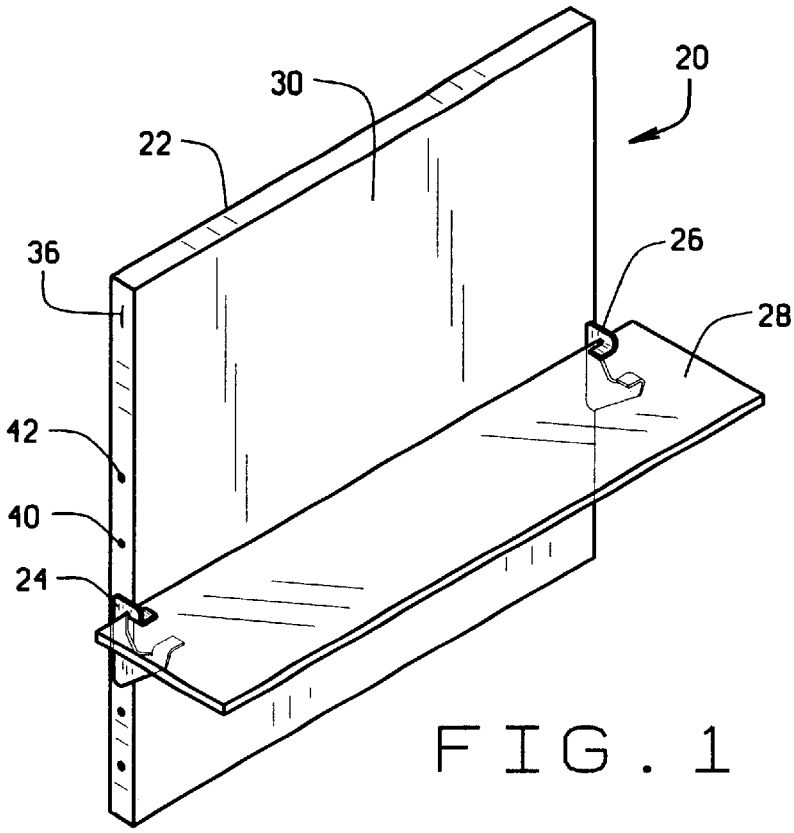
FIG. 1 is a perspective view of a primary embodiment of the shelving system of the present invention.
Figure 2:
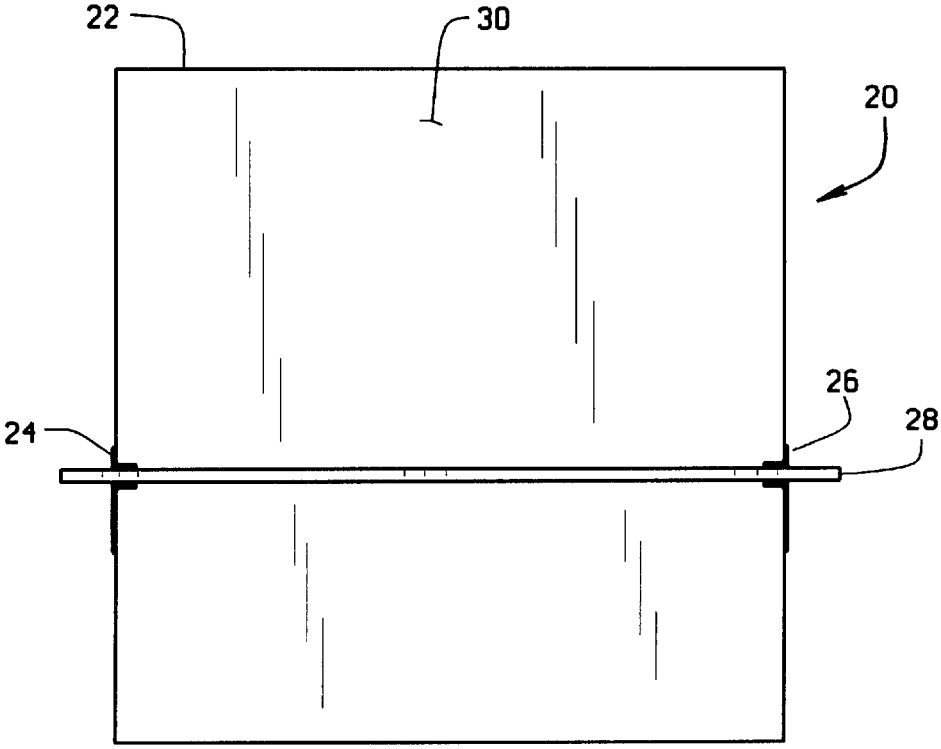
FIG. 2 is a front elevational view thereof.

The shelving system of the present invention is indicated generally by reference numeral 20 in the accompanying drawings. The shelving system 20, as shown in FIGS. 1 and 2, includes a base support or back panel 22, a first shelf clip 24, a second shelf clip 26 and a shelf 28. The various components, as well as alternative embodiments of the various components, now will be described in greater detail.

Figure 3:
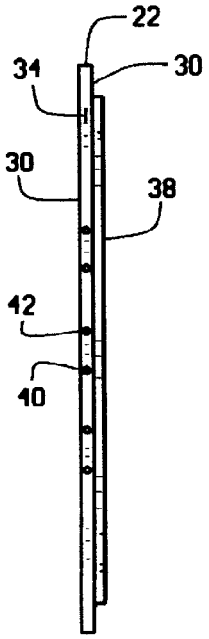
FIG. 3 is a side elevational view of the back panel of the shelving system of the present invention.
Figure 4:
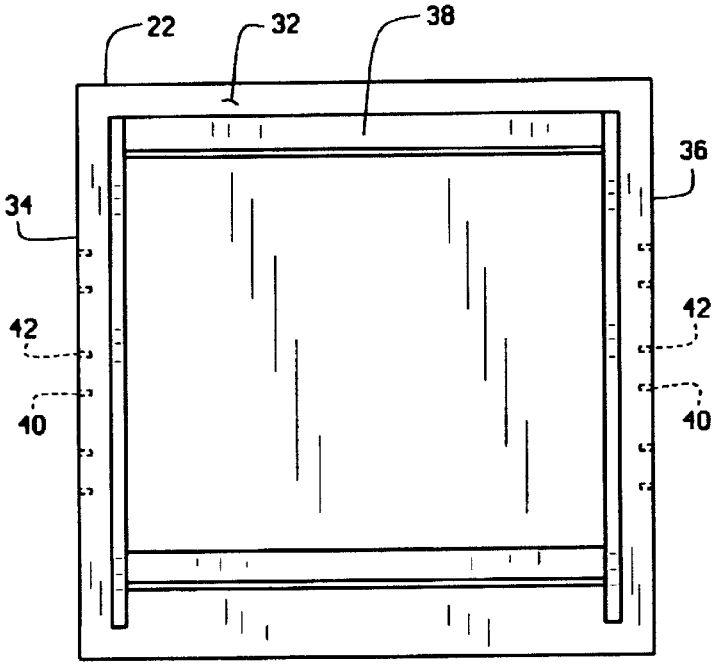
FIG. 4 is a rear elevational view thereof.

The back panel 22 is shown in detail in FIGS. 3 and 4 and includes a facing or front surface 30 and a rear surface 32 having a material thickness there between and visible as side edge 34 and side edge 36. As shown, the back panel 22 generally is rectangular in shape. However, the back panel can be of any configuration and dimensions without departing from the scope of the invention. Furthermore, the exposed surface, or front surface 30, can bear any desired indicia or decor so as to be informative, functional, decorative, or aesthetically pleasing.

In the illustrated embodiment, the rear surface 32 of back panel 22 includes a mounting frame 38. Mounting frame 38 is designed to attach directly to a support surface, such as a wall, and allow the back panel to be superposed on the wall. It will be appreciated, however, that any type of mounting or attachment apparatus may be used to mount the back panel 22 to a support surface. Moreover, the back panel 22 can be attached or mounted to a pillar, frame, rack or other support. The panel could be suspended by appropriate means or attached to legs. The side edges 34 and 36 have a plurality of holes, as at 40 and 42, formed therein in vertical alignment. The holes 40 and 42 can be grouped in pairs of two or positioned an equal distance apart along the vertical length of the side edges. In any event, the holes are positioned so that a pair of holes will accommodate the insertion of two mounting pins of the shelf clip 24 or 26 as will be explained below. It also will be appreciated that the holes 40 and 42 in side edge 34 are in horizontal alignment with the holes 40 and 42 formed in side edge 36.

Figure 5:
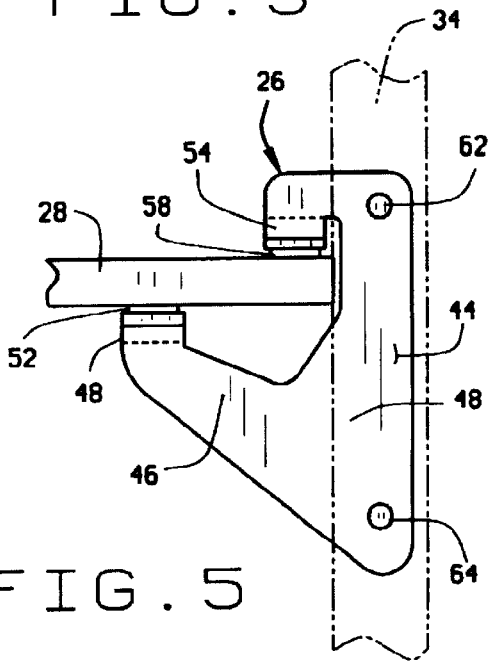
FIG. 5 is a side elevational view of a shelf clip of the shelving system of the present invention, the back panel shown in phantom to illustrate environment.
Figure 6A:
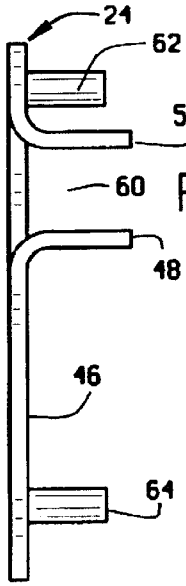
FIG. 6A is a front elevational view of a shelf clip of the shelving system of the present invention, sans replaceable pads.

As stated above, shelf clip 24 and shelf clip 26 are mirror images. As seen in FIGS. 5 and 6A, each shelf clip includes a vertical body segment 44. The vertical body segment is flat and has a substantially narrow profile. An upwardly and outwardly angled lower support arm 46 is attached to the vertical body segment 44 by web 48. As seen in FIG. 6A, the lower support arm 46 terminates in a lower shelf support 48 which is disposed or bent inwardly to be perpendicular to the vertical body segment 44. A removable friction pad 52 is attached to the lower shelf support 48.

Figure 6B:
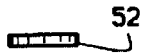
FIG. 6B is one embodiment of a replaceable pad for the shelf clip of the shelving system of the present invention.
Figure 6C:
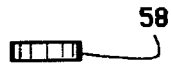
FIG. 6C is one embodiment of a replaceable pad, illustrating a thicker profile.
Figure 7:
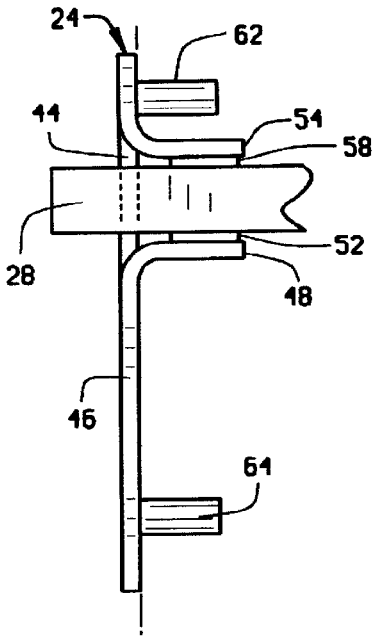
FIG. 7 is a front elevational view of a shelf clip of the shelving system of the present invention mounted to a back panel and supporting an end segment of a shelf.

Each clip also includes an upper shelf support 54 at the upper end of the vertical body segment and which is disposed or bent inwardly to be perpendicular to the vertical body segment. Upper shelf support 54 also includes a removable friction pad 58. As will be appreciated that the lower shelf support 48 and upper shelf support 54, and their respective friction pads, define a shelf space 60 there between, to seat a shelf 28, as shown in FIG. 7, in a cantilevered manner. Furthermore, by viewing FIGS. 6B and 6C it will be appreciated that removable friction pads of different thicknesses may be mounted on the shelf supports to change the dimension of the shelf space 60 so as to accommodate shelves of different thicknesses.

The friction pads 52 and 58 are constructed from a resilient, non-skid material to provide a, non-slip resting surface for a shelf. The friction pads can be self adhesive to adhere to the shelf supports. Alternatively, the friction pads can be molded with a concentric plug for insertion in a hole formed in the shelf supports (not shown). Any manner by which the friction pads are attached to the shelf supports is contemplated by the invention. A shelf 28 positioned between the pads is held in place, and is resistant to displacement, by the snug friction fit between the support pads. It will be appreciated that the clips can be fashioned from any lightweight, strong and durable material, such as aluminum or high impact plastic, and maintain, as shown in the figures, a relatively thin profile, particularly when mounted to the back panel. It also will be noted that the shelf 28 may be constructed from any preferred material such as glass, wood, marble or the like, without departing from the scope of the appended claims.

The clips also include an upper mounting pin 62 and a lower mounting pin 64 positioned respectively at the upper and lower ends of the vertical body segment 44. The mounting pins are disposed inwardly i.e. perpendicular to the body segment 44, and spaced apart an appropriate distance to allow each pin to seat in a hole 40, 42 in the side edge of the back panel. A clip is mounted on each side of the back panel and a shelf is secured in the shelf spaces to be suspended, in a cantilevered fashion, in front of the back panel. The shelf clips can be moved up or down relative to the panel by inserting the pins in higher or lower holes formed in the edges of the panel to adjust the height of the shelf relative to the panel. The downward force of the shelf on the clips effectively secure the pins in the holes, making them relatively difficult to dislodge when a shelf is in place.

It will be appreciated, by viewing FIGS. 1 and 2, that the design of the clips provides for generally unobtrusive mounting of the shelf 28 on the back panel 22. The lower and upper shelf supports, 48 and 54 respectively, tend to meld into the profile of the shelf. Moreover, the narrow profile of the clip body rests flush against side edges of the back panel and the mounting pins 62 and 64 are concealed within the holes in the side edges, effectively concealing the clips and providing the overall appearance that the shelf is suspended in front of the back panel without mounting hardware to achieve an unobtrusive, clean and aesthetically pleasing appearance.

The shelving system of the present invention may include alternative embodiments which extend the range of useful applications. For example, the shelf clips can be designed as any one of a plurality of different pieces of display hardware.

Figure 8:
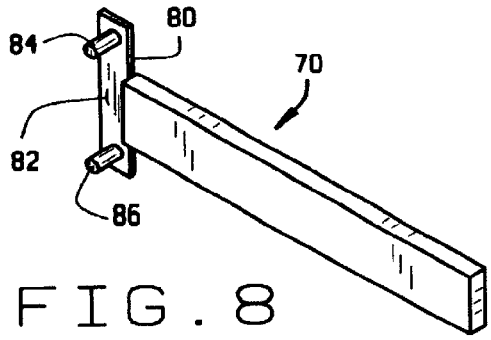
FIG. 8 is an isometric view of an illustrative alternative embodiment of a shelf clip of the shelving system of the present invention designed as display hardware embodying a straight shelf bracket.
Figure 9:
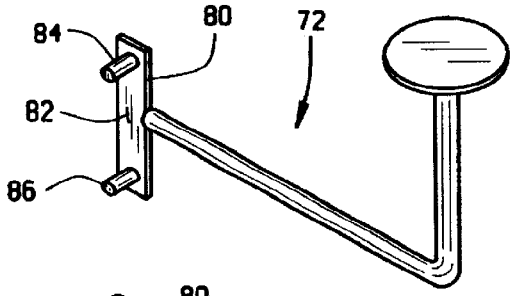
FIG. 9 is an isometric view of another illustrative alternative embodiment of a shelf clip of the shelving system of the present invention designed as display hardware embodying a hat displayer.
Figure 10:
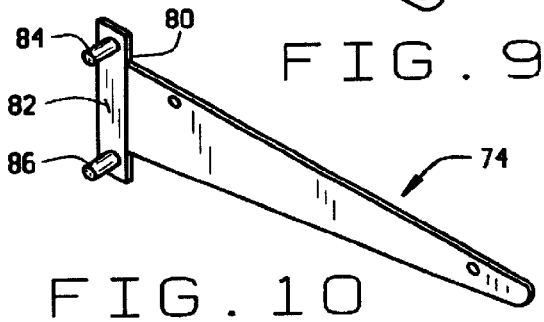
FIG. 10 is an isometric view of another illustrative alternative embodiment of a shelf clip of the shelving system of the present invention designed as display hardware embodying a tubular shelf bracket.
Figure 12:
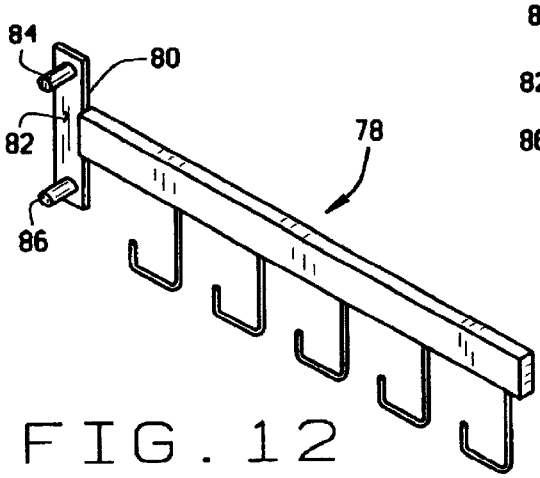
FIG. 12 is an isometric view of another illustrative alternative embodiment of a shelf clip of the shelving system of the present invention designed as display hardware embodying a straight faceout with hooks.
Figure 11:
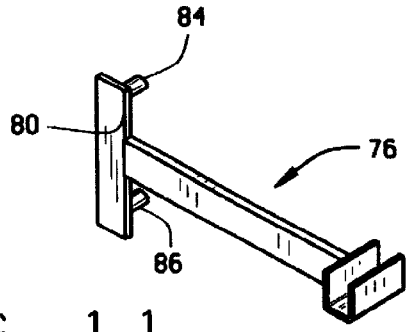
FIG. 11 is an isometric view of another illustrative alternative embodiment of a shelf clip of the shelving system of the present invention designed as display hardware hangrail support bracket.

FIGS. 8 through 12 illustrate alternative embodiments of the clips. For example, FIG. 8 illustrates a straight shelf bracket 70; FIG. 9 illustrates a hat displayer 72; FIG. 10 illustrates a tubular shelf bracket 74; FIG. 11 illustrates a hangrail support bracket 76; and FIG. 12 shows a straight faceout with hooks 78. It will be understood that each of the alternative embodiments is employed in specialized applications known to the art. However, the embodiments of FIGS. 8 through 12 include a novel mounting means at the proximal end which allows them to be used with the back panel 22 of the present invention. As can be seen, each embodiment includes a mount 80 having a substantially flat, narrow profile body segment 82. An upper mounting pin 84 and lower mounting pin 86 are disposed inwardly from, and perpendicular to, the body segment 82. The respective mounting pins are dimensioned and positioned so engage holes 40 and 42 in the side edges of a back panel in the same manner as described above with regard to clips 24 and 26.

It will be understood that various changes and modifications may be made in the shelving system of the present invention without departing from the scope of the appended claims. Therefore, the foregoing description and accompanying drawings are intended to be illustrative only and should not be construed in a limiting sense.

What is claimed is:

1. A shelving system comprising:

a panel, said panel having a first side edge and a second side edge, said first and second side edges having at least two holes formed therein;

a first shelf clip and a second shelf clip, said first and second shelf clips each having a body segment, each body segment including an upper shelf support and an opposed lower shelf support, said upper and lower shelf supports defining a shelf mounting space there between, each said first and second shelf clip including a first and second mounting pin perpendicular the body segment, each said mounting pin of said first shelf clip disposed to engage one each of said at least said two holes formed in said first side edge of the panel and each said mounting pin of said second shelf clip disposed to engage one each of said at least two holes formed in said second side edge of said panel; and a shelf positioned in the shelf mounting space of each said first and second shelf clip.

2. The shelving system of claim 1 wherein the upper shelf support and lower shelf support of each said first and second shelf clips further comprises a replaceable friction pad.

3. The shelving system of claim 2 wherein said replaceable friction pad is provided in a plurality of thicknesses.

4. The shelving system of claim 2 wherein the upper shelf support and lower shelf support of each said first and second shelf clips have the replaceable friction pad removably adhered thereto.

5. The shelving system of claim 1 wherein said panel further comprises a mounting apparatus for mounting the back panel to a surface.

6. The shelving system of claim 3 wherein a dimension of each said shelf mounting space of each said shelf clip can be adjusted by the replacement of the replaceable friction pad with a replaceable friction pad having another of the plurality of thicknesses.

7. An improved shelving system comprising:

a support panel, said support panel having a first side edge and a second side edge, said first and second side edges having at least two openings formed therein;

a first shelf clip and a second shelf clip, said first and second shelf clips each having a body segment, each body segment of each said first and second shelf clip including an upper shelf support with a friction pad mounted therein and an opposed lower shelf support with a friction pad mounted therein, said friction pads of said upper and lower shelf supports defining a shelf mounting space there between, each said first and second shelf clip including an upper mounting pin and a lower mounting pin, said mounting pins disposed perpendicular to the body segment, each said mounting pin of said first shelf clip disposed to engage one each of said at least said two openings formed in said first side edge of the panel and each said mounting pin of said second shelf clip disposed to engage one each of said at least two openings formed in said second side edge of said panel; and a shelf frictionally secured within the shelf mounting space of each said first and second shelf clip.

8. The improved shelving system of claim 7 wherein the said friction pads of said upper and lower shelf supports are replaceable.

* * * * *

UNITED STATES PATENT AND TRADEMARK OFFICE

CERTIFICATE OF CORRECTION

PATENT NO. : 6,364,263 B1
DATED : April 2, 2002
INVENTOR(S) : Ryan

It is certified that error appears in the above-identified patent and that said Letters Patent is hereby corrected as shown below:

Title page,
Item [*] Notice, delete the phrase "by 0 days" and insert -- by 66 days --

Signed and Sealed this

Seventh Day of June, 2005

JON W. DUDAS
*Director of the United States Patent and Trademark Office*

UNITED STATES PATENT AND TRADEMARK OFFICE

CERTIFICATE OF CORRECTION

PATENT NO. : 6,364,263 B1
DATED : April 2, 2002
INVENTOR(S) : James A. Ryan

It is certified that error appears in the above-identified patent and that said Letters Patent is hereby corrected as shown below:

Column 2,
Lines 63-65, delete "FIG. 7 is Fig. 6A is a front elevational view of a shelf clip of the shelving system of the present invention mounted to a back panel and supporting an end segment of shelf;".

Signed and Sealed this

Thirty-first Day of January, 2006

JON W. DUDAS
*Director of the United States Patent and Trademark Office*